United States Patent [19]

Cooper et al.

[11] Patent Number: 4,492,306

[45] Date of Patent: Jan. 8, 1985

[54] MAGAZINE PAGE DEHYDRATED FOODS IN PLASTIC BAGS

[75] Inventors: Penny S. Cooper, 336 W. 71st St., New York, N.Y. 10023; Richard L. Miller, Dix Hills, N.Y.

[73] Assignee: Penny S. Cooper, New York, N.Y.

[21] Appl. No.: 571,334

[22] Filed: Jan. 16, 1984

[51] Int. Cl.[3] ..... B65D 27/00; B65D 85/72

[52] U.S. Cl. ..... 206/216; 206/232; 206/472; 206/525

[58] Field of Search ..... 206/216, 232, 472, 484, 206/525; 383/38, 100

[56] References Cited

U.S. PATENT DOCUMENTS

| | | | |
|---|---|---|---|
| 1,689,637 | 10/1928 | Mordecai | 206/232 |
| 2,801,002 | 7/1957 | Volckening et al. | 206/472 |
| 4,369,882 | 1/1983 | Schlugee | 206/216 |
| 4,433,783 | 2/1984 | Dickinson | 383/38 |

*Primary Examiner*—William T. Dixson, Jr.
*Attorney, Agent, or Firm*—Richard L. Miller

[57] ABSTRACT

An advertising/promotional/marketing/device. A removed pouch containing dehydrated food and faced with advertisement bound into the spline of a magazine to form a page within same. The pouch is assembled by use of pressure sensitive seams and ZIPLOC® closures. The page is removable from the magazine by simple tearing or releasing of VELCRO® binding.

5 Claims, 3 Drawing Figures

MAGAZINE PAGE DEHYDRATED FOODS IN PLASTIC BAGS

BACKGROUND OF THE INVENTION

This invention relates to advertising devices but more particularly to advertising devices which are particularly designed for the distribution of samples or specimens of the goods to be advertised in a magazine or other printed or promotional materials.

In advertising various commodities, it has been the practice to distribute literature relating to the commodity, through the mails and other channels usually employed for the purpose, and at a subsequent time, or in some cases, simultaneously distribute samples or specimens of the goods described in the advertising matter or literature. This practice has been found to have many disadvantages, largely from the fact that where the printed matter and the samples of the commodity described therein are distributed at intervals, the literature is frequently lost or destroyed before the samples of the goods are received, so that any interest that may have been created in the commodity advertised is substantially, if not wholly nullified, and the result sought by the advertiser is not attained. On the other hand, where the advertising matter and samples of the commodities are simultaneously distributed, they are generally in separate packages and, even where the interest in the goods and the literature pertaining thereto is sufficient to result in the preservation of both, the fact that one is detached from the other in the majority of instances results in the loss of literature, or the samples of goods, so that the ultimate result to the advertiser is unsatisfactory.

SUMMARY OF THE INVENTION

Accordingly, it is an object of the present invention to provide an advertising device wherein the description of a certain article or commodity is cooperatively associated with samples or specimens of the article or commodity, in such a manner that the preservation of the advertising matter will result in the preservation of the samples or specimens and vice versa.

It is another object of the present invention to display the samples or specimens, so that the interest of the recipient is aroused and maintained during his consideration or perusal of the descriptive matter and, at the same time, to provide a compact package which may be readily handled and accessible as a page in a magazine.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

DETAILED DESCRIPTION OF THE PREFERRED EMBODIMENT

Figure 1:
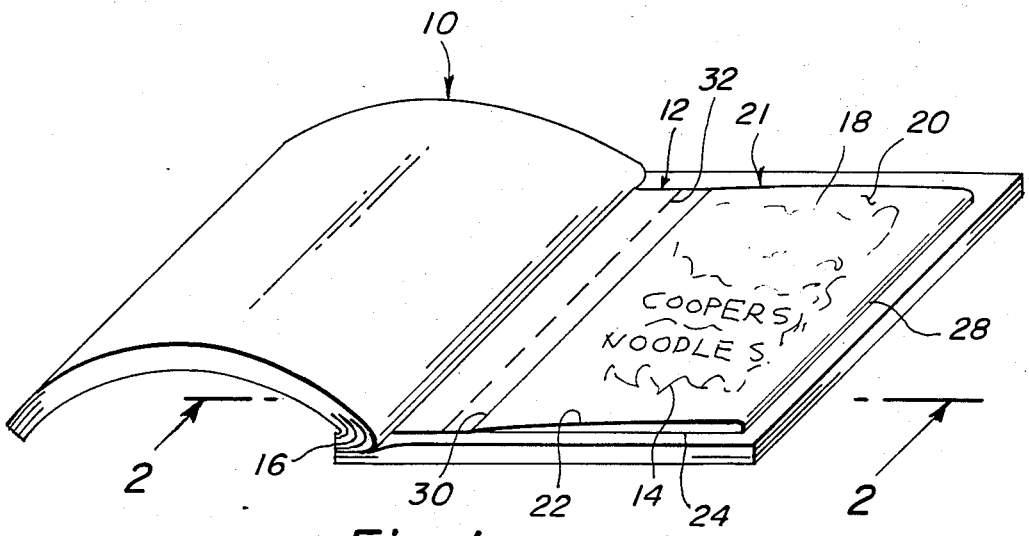
FIG. 1 is a perspective view of the invention illustrated in place in a magazine.

Referring now to FIG. 1, there is shown a magazine 10 having a page 12 containing dehydrated food 14. Page 12 is inserted into spine 16 of magazine 10 as the pages of magazine are bound. Page 12 containing the dehydrated food sample 14 has advertising material 18 depicted on its face 20. Page 12 has the configuration of a pouch 21 having a face portion 22 and a bottom portion 24.

Figure 2:
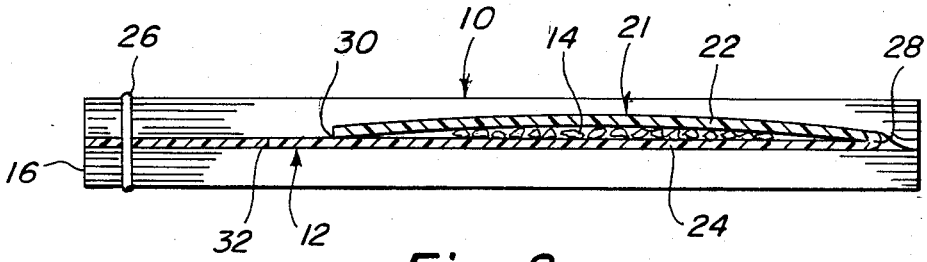
FIG. 2 is a cross sectional view taken on line 2—2 in FIG. 1.

As shown in FIG. 2, one can see the preferred embodiment of the present invention in which bottom portion 24 of pouch 21 is inserted into spine 16 when magazine 10 is being bound by staple or stiching 26. Face portion 22 of pouch 21 is folded at 28 from bottom portion 24. Face portion 22 overlaps bottom portion 24 and is pressure sensitively attached at 30 to bottom portion 24 to close pouch 21. Bottom portion 24 preferably has a perforated cut 32 so as to permit the pouch 21 with its contents to be easily removed from the magazine. It is to be understood that pressure sensitive in this text may imply, heating sealing, plastic cements, or any other methods of securing plastic to plastic known in the art. It is to be further understood that although plastic is a highly desirable choice of material to fabricate the instant invention that there are other suitable materials and the reference to plastic in this specification, is in no way to be construed as a limitation upon the choice of such other suitable materials.

Figure 3:
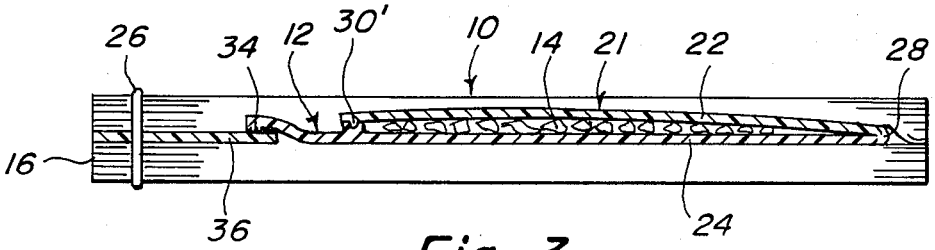
FIG. 3 is a cross sectional view similar to FIG. 2 of a modified form of the in[illegible]tion.

An alternate embodiment of the present invention is shown in FIG. 3. Face portion 22 of pouch 21 is again folded at 28 from bottom portion 24, however, face portion 22 is attached to bottom portion 24 by means of a ZIPLOC® closure 30'. Instead of page 12 being inserted directly into spline 16 of magazine 10 it is connected by loop pile fastener strip 34 (hereafter referred to by the trademark VELCRO®) to an insert 36 which is bound by stitching 26 to spline 16. This feature permits the pouch to be installed at a later time after the magazine has been bound, or alternately permits the user to remove and reinstall the pouch at will. It is to be noted that either VELCRO® or ZIPLOC® may be used as a securement mechanism 34, or sealing device 30' depending upon the choice of the manufacture and the contents of the pouch etc.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A magazine advertising device, comprising:

a sheet of material bound into a magazine as a page thereof, said sheet being folded onto itself about a fold line thereby defining a base layer and a cover layer, the fold line therebetween defining the outer edge of the page, advertising means formed onto the outer face of said cover layer, fastening means for securing the inner edge of the cover layer onto the base layer to define a pouch therebetween for receiving samples of the goods advertised on the cover layer, securing means for binding the inner edge of the base layer into the magazine, and detaching means for separating the portion of the body layer containing said pouch from the portion of the body layer bound in the magazine.

2. A magazine advertising device as in claim 1, where said fastening means comprises a pressure sensitive fastener.

3. A magazine advertising device as in claim 1, wherein said fastening means secures the upper and lower edges of said cover layer onto said base layer.

4. A magazine advertising device as in claim 1, wherein said fastening means comprises a ZIPLOC® fastener.

5. A magazine advertising device as in claim 1, wherein said detaching means comprises a VELCRO® fastener.

* * * * *